United States Patent [19]

Pearl

[11] 4,452,113

[45] Jun. 5, 1984

[54] METHOD AND APPARATUS FOR SEALING CUT SHEET MATERIAL

[75] Inventor: David R. Pearl, West Hartford, Conn.

[73] Assignee: Gerber Garment Technology, Inc., South Windsor, Conn.

[21] Appl. No.: 367,430

[22] Filed: Apr. 12, 1982

[51] Int. Cl.[3] ..... B26D 3/00

[52] U.S. Cl. ..... 83/56; 83/152; 83/422; 83/451; 83/925 CC

[58] Field of Search ..... 83/13, 39, 56, 71, 152, 83/216, 217, 263, 451, 747, 734, 925 CC

[56] References Cited

U.S. PATENT DOCUMENTS

| | | | |
|---|---|---|---|
| 3,495,492 | 2/1970 | Gerber et al. | 83/374 |
| 3,682,750 | 8/1972 | Gerber | 83/925 CC |
| 3,742,802 | 7/1973 | Maerz | 83/451 |
| 3,777,604 | 12/1973 | Gerber | 83/925 CC |
| 3,797,341 | 3/1974 | Bystron | 83/925 CC |
| 4,322,993 | 4/1982 | Stumpf | 83/925 CC |
| 4,328,726 | 5/1982 | Pearl | 83/217 |
| 4,345,496 | 8/1982 | Pearl | 83/925 CC |

*Primary Examiner*—Frank T. Yost
*Assistant Examiner*—Hein H. Phan
*Attorney, Agent, or Firm*—McCormick, Paulding & Huber

[57] ABSTRACT

An automatically controlled cutting machine includes a conveyor table having an endless conveyor belt for moving segments of limp sheet material onto the table for cutting. A cutting carriage and blade are mounted for controlled movement over the support surface of the table to cut pattern pieces from the limp sheet material positioned on the surface. A vacuum system holds the material in a compressed state on the surface during cutting, and a sealing carriage is coupled with the cutting carriage to spread an air-impermeable overlay which seals the material when cut. Before the conveyor belt moves the cut segment of the sheet material off of the table, the sealing carriage is uncoupled from the cutting carriage, and the overlay is wound onto a self-retracting roller on the sealing carriage. The carriage is simultaneously drawn by the overlay toward one end of the table where the carriage remains parked as the cut segment moves off the table.

12 Claims, 7 Drawing Figures

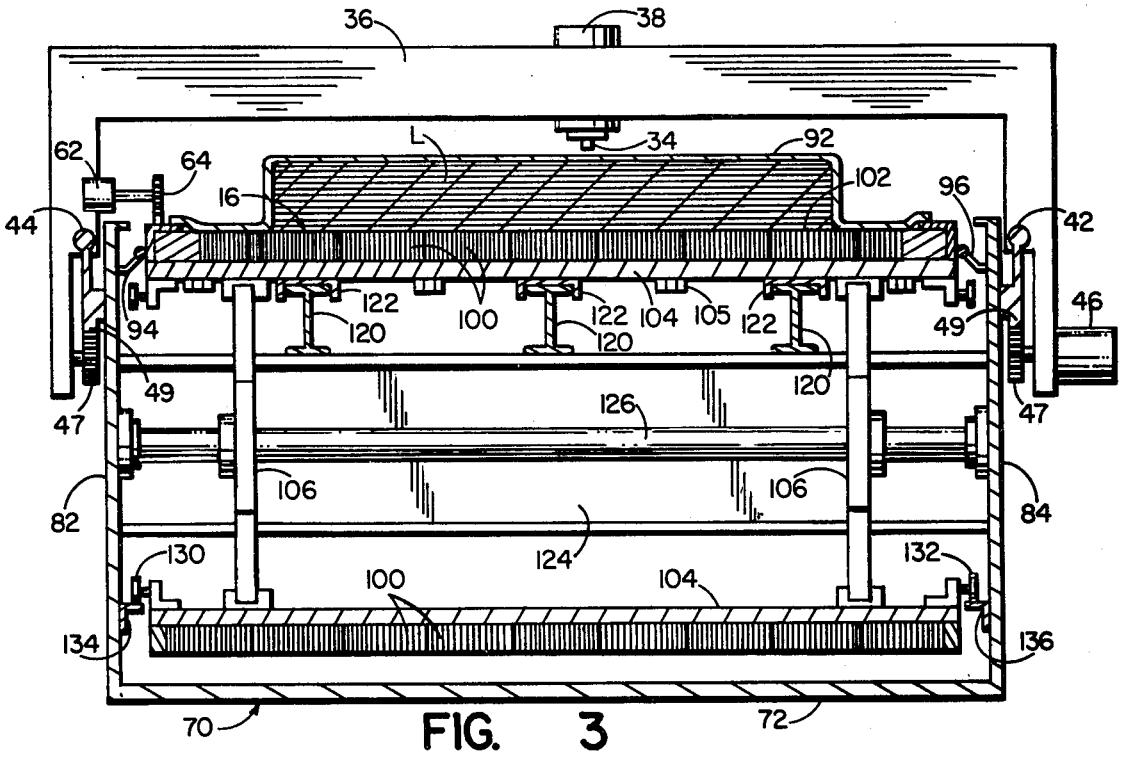
FIG. 3
FIG. 4
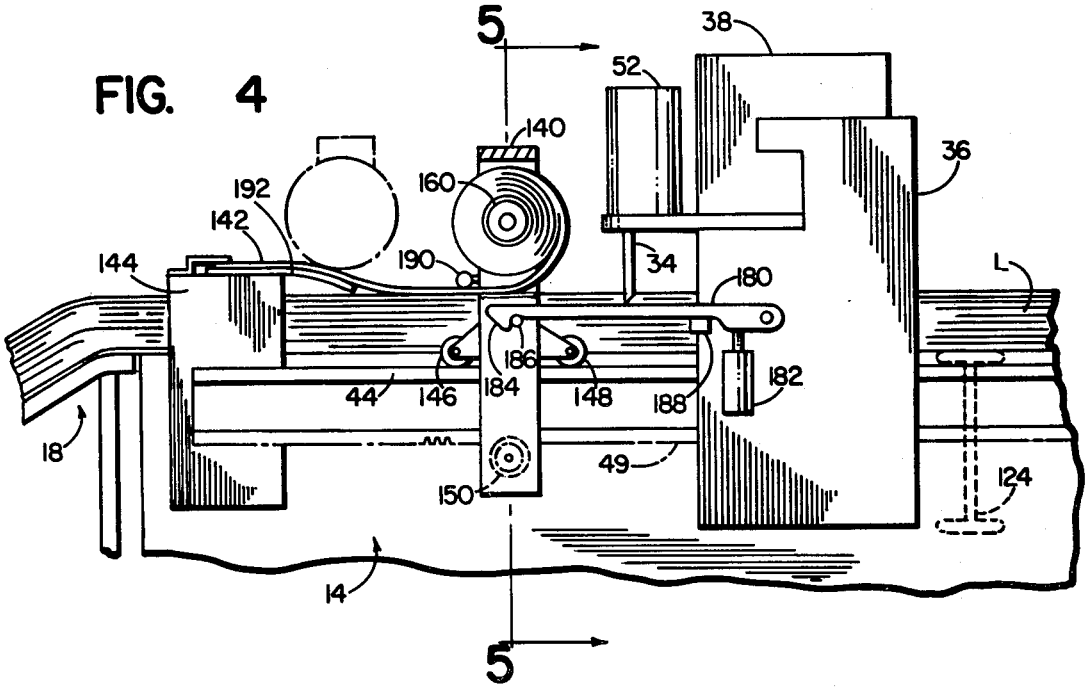
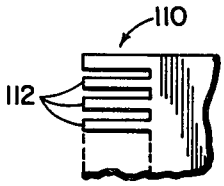
FIG. 7

METHOD AND APPARATUS FOR SEALING CUT SHEET MATERIAL

BACKGROUND OF THE INVENTION

The present invention resides in a method and apparatus for working on limp sheet material, particularly layups of limp sheet material which are cut by an automatically controlled cutting blade.

Prior art cutting systems which include automatically controlled cutting machines for limp sheet material are shown in U.S. Pat. No. 3,495,492 and U.S. patent application Ser. No. 4,328,726, having the same assignee as the present invention. Each of these prior art machines employs a vacuum holddown system in the cutting table on which the limp sheet material is positioned for cutting. When vacuum is applied to the material, the material is compressed and held fixedly in position on the table to perform the cutting with greater ease and accuracy.

The limp sheet materials cut on automatically controlled machines include woven and non-woven fabrics, leather, paper, synthetics such as vinyl, plastic, foils, composites and other materials, and frequently the materials are cut in patterns that are arranged in a closely nested array called a "marker" to minimize the amount of material wasted. Generally, a marker of pattern pieces used, for example, to manufacture garments, may have overall dimensions of 6 feet (2 meters) in width and 24 feet (8 meters) or more in length. The pattern pieces are cut in a single operation by laying the sheet material in a multi-ply stack called a layup, and cutting the pattern pieces from the layup. Conveyorized cutting tables having a length less than the overall length of a single layup are commonly used and cut the layup in two or more sequential segments. A first segment is positioned on the work surface of the conveyor table for cutting in a first operation, and then the second segment or "bite" is moved onto the table for cutting while the first segment is removed.

Since substantial energy is required to evacuate the layup of sheet material, particularly after the material has been partially cut by the blade, the prior art cutting machines have employed a zoned cutting table. In a zoned table, vacuum is applied only to a limited portion of the layup where the cutting blade is operating. The cutting carriage supporting the blade controls the application of vacuum to the appropriate portion of the table through a system of valves and chambers within the bed of the table.

While the zoned cutting tables are intended to reduce the loss of vacuum within a layup and to minimize the amount of energy required to hold the sheet material firmly in position during cutting, their construction is complex and expensive, and substantial leakage occurs through the cuts in the material and also through the table bed which is generally made from a porous material such as bristles to prevent damage to the reciprocating cutting blade. Attempts to reduce leakage in addition to zoning the table have included the installation of air impermeable barriers in the otherwise air-permeable bed to stop horizontal flow of air between the active and inactive zones, the placement of an air-impermeable overlay on the layup of limp sheet material and the exposed portions of the bed and the mounting of endless belts of air-impermeable material on top of the layup to cover the holes or kerfs produced in the material by the cutting operation.

Another approach designed to minimize leakage and loss of vacuum through cut material is shown in U.S. Pat. No. 3,742,802. In this patent, two air-impermeable overlays are wound in opposite directions about two spaced and parallel rollers respectively, and the rollers are mounted on the cutting carriage with the cutting blade. The free ends of the overlays are secured to opposite ends of the cutting table so that the overlay material is wound on and off of the rollers in the manner of a roller shade as the cutting carriage moves back and forth over the table while the blade is cutting. In this prior art, the only portion of the layup exposed during cutting is that portion of the material lying in the gap provided between the two spaced rollers to permit the cutting blade to reach the material. In contrast to the sacrificial overlays that are cut by the blade, the rolled overlays in U.S. Pat. No. 3,742,802 are not cut and may be used again and again in many cutting operations.

It is an object of the present invention to provide an automatically controlled cutting machine that employs a sealing carriage for spreading an air-impermeable overlay over the sheet material during cutting and removing the overlay thereafter for removal of the cut material.

SUMMARY OF THE INVENTION

The present invention resides in a method and apparatus for cutting limp sheet material while the material is held firmly in position with vacuum.

The apparatus which performs the method includes a cutting table, such as a conveyor table having an endless conveyor belt for moving a layup of limp sheet material between one end of the table and the other. The belt defines a work support surface for holding the sheet material as it is moved on and off of the table and also while the material is being cut. The table has a vacuum system for holding the sheet material fixedly on the support surface in a compressed condition for cutting. Preferably the conveyor belt is an air-permeable belt, and the vacuum system communicates with the sheet material through the belt.

When the sheet material is air-impermeable or made air-impermeable by an overlay, a vacuum is drawn in the material and atmospheric pressure compresses the sheet material firmly in position on the support surface. A tool carriage then moves a cutting tool such as a reciprocated cutting blade, over the sheet material in a cutting operation, and cuts, for example, pattern pieces in accordance with a predetermined cutting program.

As the overlay and the sheet material are cut, and air leaks through the material at the cuts to the vacuum system, an air-impermeable overlay is spread over the cut portions of the sheet material by a sealing carriage. The sealing carriage is coupled with the tool carriage for movement during cutting and is released from the tool carriage to remove the overlay from the sheet material when cutting is complete. The overlay is retrieved on a self-retracting roller on the sealing carriage, and simultaneously draws the sealing carriage toward a parking position on the cutting table.

BRIEF DESCRIPTION OF THE DRAWINGS

FIG. 3 is an enlarged sectional view of the cutting machine as seen along the sectioning line 3—3 of FIG. 2.

FIG. 4 is an enlarged fragmentary side elevation view of the cutting machine in FIG. 2 and shows the sealing carriage partially broken away and coupled to the cutting carriage.

FIG. 7 is a fragmentary top plan view of a transfer comb at one end of the conveyor shown in FIG. 6.

DESCRIPTION OF THE PREFERRED EMBODIMENTS

Figure 1:
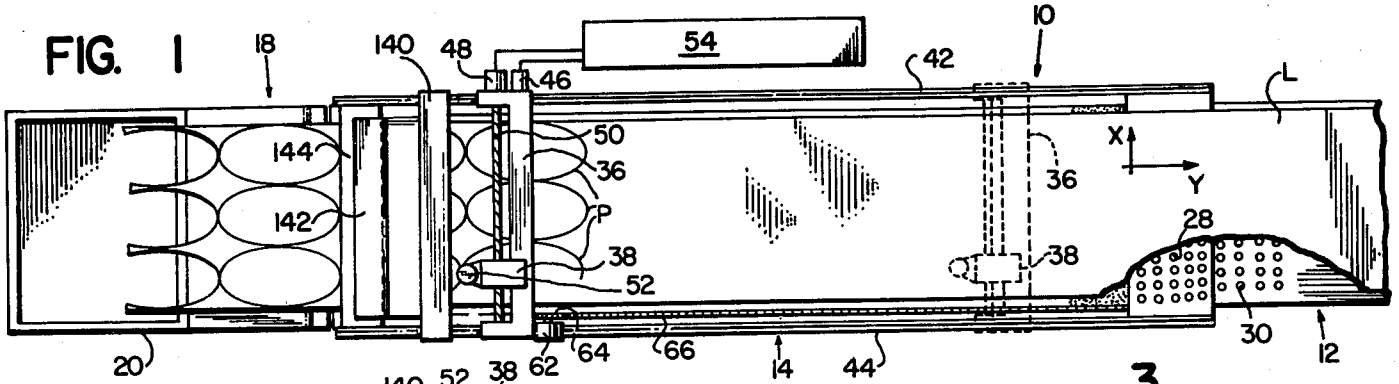
FIG. 1 is a plan view of an automatically controlled cutting machine embodying the present invention.
Figure 2:
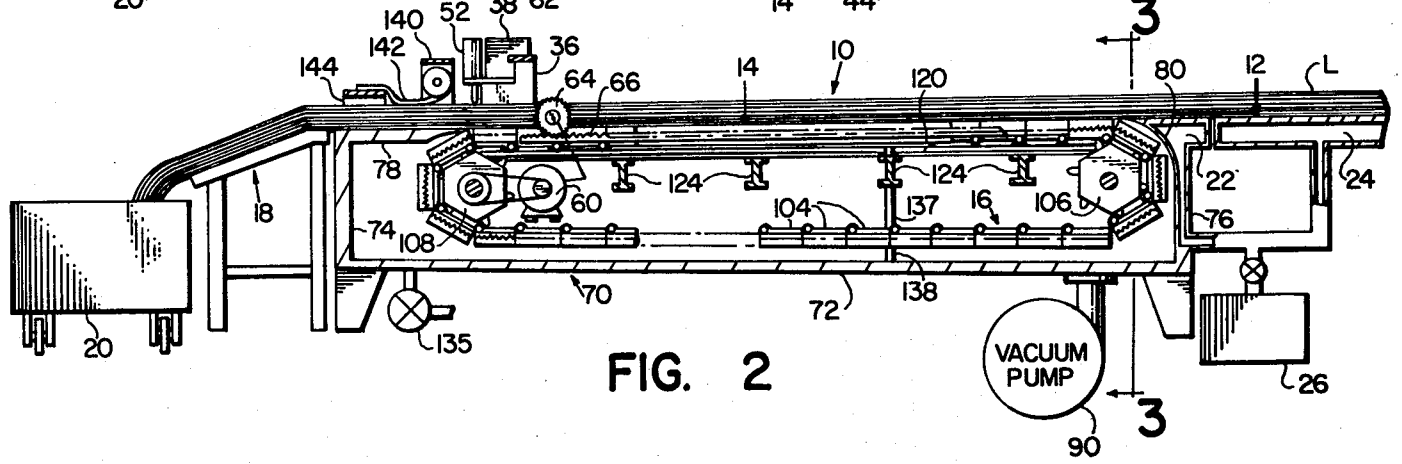
FIG. 2 is a side elevation view of the cutting machine in FIG. 1.

FIGS. 1 and 2 illustrate an automatically controlled cutting machine, generally designated 10, which is constructed in accordance with the present invention. The machine 10 is used to cut pattern pieces P from a multiply layup L of limp sheet material. The sheet material typically is a woven or non-woven fabric but may include a number of other materials such as synthetics, plastics, paper, leather and other such materials. The pattern pieces can have a variety of sizes and shapes and are layed out in an array or "marker" for most economical use of the sheet material. Typically, the pattern pieces may be used to manufacture garments or upholstery, but the number and type of end products are unlimited.

The layup L of limp sheet material may be formed by simultaneously drawing a plurality of sheets from a corresponding plurality of bolts of cloth. In the present case, however, the layups are formed by a cloth spreader (not shown) on a spreading table 12 adjacent one end of the cutting machine 10.

The cutting machine 10 is comprised by a conveyor table 14 which supports one segment of the layup L during a cutting operation. The table includes a motor driven conveyor belt 16 which moves the layup from the spreading table onto the conveyor table for cutting and off of the table after cutting. The conveyor belt 16 extends from the loading end of the table abutting the spreading table 12 to the opposite, unloading or discharging end abutting a sloped discharge table 18. The cut pattern pieces P in the layup L are tied or bound in bundles on the discharge table and are then removed to a sewing or assembly room. The remaining cloth is dumped in the cart 20.

To facilitate movement of the layup L from the spreading table 12 onto the conveyor table 14, an air flotation apparatus is provided in the abutting aprons of the conveyor and spreading tables. An air pump 26 supplies a large volume of low pressure air to the chambers 22, 24 in the respective tables, and the supporting surfaces of the table aprons are provided with apertures 28, 30 as shown in FIG. 1 to generate an air bearing between the supporting surfaces and the layup. The air bearing supports the layup with minimal friction when the motor driven conveyor belt 16 moves a segment of the layup onto the conveyor table.

A cutting tool in the form a reciprocating cutting blade 34 is mounted over the conveyor table 14 by means of two cutting tool carriages, an X-carriage 36 and a Y-carriage 38. The X-carriage is mounted on guide ways 42, 44 on opposite lateral sides of the conveyor table and moves back and forth with the cutting blade 34 and the Y-carriage 38 under the driving forces of an X-drive motor 46. The drive motor 46 rotates pinions 47 (FIG. 3) which engage stationary racks 49 under the guide ways to precisely control the movement of the carriage in the X-coordinate direction.

The Y-carriage 38 is mounted on the X-carriage 36 and moves relative to the conveyor table 14 in the illustrated Y-coordinate direction under the control of a Y-drive motor 48 and a lead screw 50 engaging the Y-carriage. The cutting blade 34 is suspended from the Y-carriage 38 and a rotational drive motor 52 also mounted on the Y-carriage orients the cutting blade in a direction generally tangent to the line of cut through the layup of sheet material. All of the drive motors 46, 48 and 52 and a reciprocation drive motor (not shown) connected with the blade are operated by a control computer 54 in response to a cutting program which defines the contours and positioning of the pattern pieces P as cut from the layup L.

When all of the pattern pieces P have been cut in the one segment of the layup on the support surface of the conveyor table 14, the cutting operation is momentarily interrupted and a conveyor drive motor 60 is energized to drive the conveyor and move a new, uncut segment onto the table from the spreading table 12. The cut portion of the layup, at the same time, is moved off the discharged end of the conveyor table to the table 18 where the cut pattern pieces are bundled and removed.

In one form of the cutting machine 10, a cutting operation is initiated near the discharge end of the conveyor table 14 and the cutting blade 34 works progressively along the table and cuts pattern pieces until the carriages 36 and 38 reach the phantom position illustrated in FIG. 1 adjacent the loading end of the table. In preparation for a material moving or indexing operation, a rotary encoder 62 mounted on the X-carriage 36 is energized to measure any relative movement between the X-carriage and the conveyor belt 16. To this end, the encoder has a pinion 64 engaged with a segmented gear rack 66 mounted on the conveyor belt 16. As the X-carriage 36 is moved from the phantom position in FIG. 1 back to the solid-line position, the output signal of the encoder 62 is applied to the conveyor drive motor 60 to energize the motor and cause the conveyor to be slaved to and move jointly with the X-carriage 36. In this manner, the position of the sheet material on the conveyor can be precisely coordinated with the position of the X-carriage in the cutting program. If there is any discrepancy between the X-carriage position and the indexed position of the layup after a new segment has been moved onto the conveyor table, an error detection circuit may be used to readjust the X-carriage in the X-coordinate direction. For a more complete description of the indexing or "bite-feeding" operation, reference may be had to U.S. Pat. No. 4,328,726 by the assignee of the present application.

The conveyor belt 16 of the table 14 is mounted within an air-tight enclosure 70 that envelops the conveyor belt except for the portion of the belt defining the support surface on which the layup of sheet material is held. The enclosure 70 as seen in FIG. 2 includes a bottom wall 72, two end walls 74, 76 and two aprons 78 and 80 that bridge the opening between the end walls 74, 76 and the opposite longitudinal ends of the conveyor belt 16, respectively. Additionally, as shown in FIG. 3, the enclosure includes two lateral side walls 82, 84 which are connected with the bottom wall 72, the two end walls 74, 76 and aprons 78, 80 at the opposite ends of the table. The walls are air-impermeable and are welded or otherwise joined together in sealing relationship so that they form an air-tight, tank-like vessel in which the conveyor is positioned. All connections into the enclosure 70 from the exterior side of the table are sealed and thus, air can only enter the enclosure through the opening at the top that is substantially occupied by the support surface of the conveyor.

A vacuum pump 90 is connected to the bottom wall 72 so that the enclosure 70 effectively forms a vacuum chamber when limp sheet material is positioned on the conveyor belt and an air seal is established over the sheet material and the portion of the enclosure opening around the material. Such a seal is formed by means of an air-impermeable overlay material 92 shown in FIG. 3 on top of the layup and a set of sliding seals 94, 96 along the upper run of the conveyor belt 16 at each lateral side respectively. The overlay material 92 is spread on top of the layup after the layup has been formed on the spreading table 12.

Figure 5:
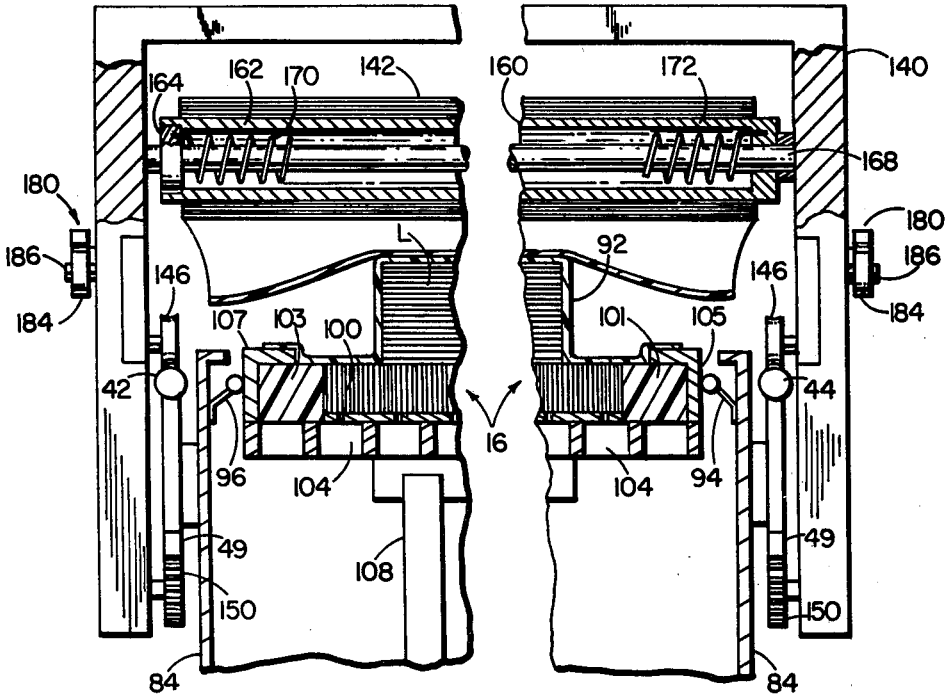
FIG. 5 is an enlarged cross sectional view of the cutting table as viewed along the sectioning line 5—5 in FIG. 4 with the central portion broken away.
Figure 6:
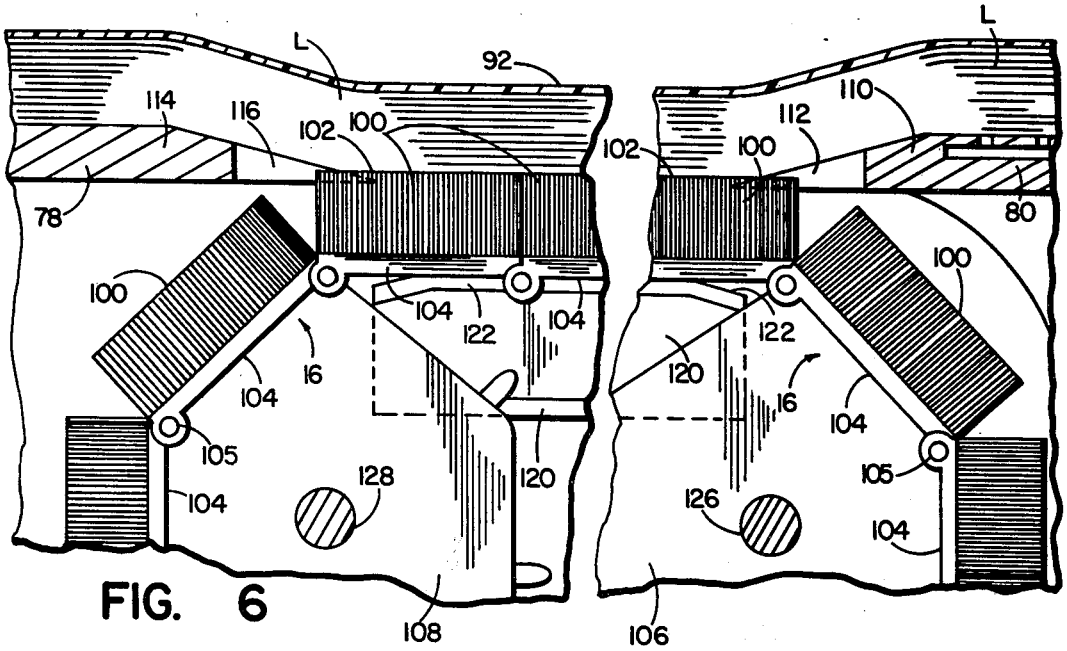
FIG. 6 is an enlarged, fragmentary elevation view showing the opposite ends of the conveyor in the cutting machine.

As shown in FIGS. 3, 5 and 6, the conveyor belt 16 in one embodiment is air-permeable and comprised by perforated blocks 100 of bristles with the bases being perforated and the bristles have free ends projecting outwardly of the conveyor and defining the support surface 102 on which the layup L of limp sheet material is held. Rows of the blocks 100 are held on perforate grid sections 104 as shown most clearly in FIG. 5 so that air-evacuated from the layup L is drawn downwardly into the chamber formed by the enclosure 70 and, at the same time, the limp sheet material is compressed on the support surface 102. For further description of the grid sections and the bristle blocks, reference may be had to U.S. Pat. No. 4,328,726, referenced above.

Along the lateral edges of the conveyor belt 16, the bristle blocks 100 are bounded by air-impermeable barrier blocks 101, 103 and sealing bars 105, 107 respectively. The sliding seals 94, 96 rest on the bars 105, 107 respectively and maintain a seal to close the enclosure 70 during cutting and during the interval when the layup of sheet material is being moved by the conveyor. The air-impermeable overlay 92, together with the blocks and side bars, completely seal the opening along each lateral edge of the layup between the layup and the lateral side walls 82, 84.

As shown in FIG. 6, each of the grid sections 104, together with the associated bristle blocks, are interconnected by hinges 105 to form the segmented conveyor belt 16. Star wheels or sprockets 106 engage the individual sections at the loading end of the conveyor, and a similar set of star wheels 108 drivingly engage the sections at the opposite end. In FIG. 2, the star wheels 108 are driven by the conveyor drive motor 60 to advance the conveyor belt 16 and pull the layup of sheet material onto the conveyor table 14 from the spreading table 12 and move the cut portion of the layup off of the conveyor table at the opposite end onto the discharge table 18.

At the loading end of the conveyor table 14, the apron 80 includes a transfer comb 110 shown in FIGS. 6 and 7 with a plurality of sloped teeth 112 projecting into the bristles of the blocks 100. The teeth 112 slope from the apron downwardly to a plane slightly below the level of the support surface 102 defined by the bristle blocks so that the multi-ply layup of sheet material can flow smoothly over the air bearing formed on the apron 80 onto the suppport surface of the conveyor without distorting or severely stretching the material in the loading process.

Similarly, the apron 78 at the unloading end of the conveyor table includes a similar comb 114 with sloped teeth 116 to lift the layup off of the support surface 102 and guide the layup smoothly over the apron 78 without distortion or stretching of the cut material. The teeth 116 slope upwardly from a plane slightly below the support surface 102 to ensure that the cut pattern pieces are lifted off of the surface as the grid sections 104 and the bristle blocks 100 revolve from the upper to the lower runs of the conveyor.

It should be apparent that the layup of sheet material and the air impermeable overlay 92 seal the opening in the enclosure 70 in the apron regions at opposite longitudinal ends of the conveyor table 14. The overlay 92 and the sliding seals 94, 96 seal the opening along the lateral sides of the layup and the conveyor belt as stated above. Consequently, a substantially complete seal over the opening prevents leakage of air from above the layup into the vacuum chamber formed within the enclosure and reduces the work load on the vacuum pump 90 while at the same time maintaining a desired pressure differential across the layup for compressing the sheet material and holding the material in place for cutting.

Since the downward forces produced by the weight of the layup L and atmospheric pressure operating on the overlay material 92 and the layup are substantial when vacuum within the enclosure is only a few inches of water below atmospheric pressure, a substantial load must be supported by the upper run of the conveyor belt 16. For this reason, a plurality of beams 120 extend longitudinally under the upper run of the conveyor. As shown in FIG. 6, the beams 120 extend substantially between the axles 126 and 128 for the star wheels 106, 108 respectively, and include a slight bevel at each end in order to smoothly transfer the loads on each grid section 104 between the star wheels and the beams 120. The upper surface of the beams 120 is coated or covered with a low friction bearing material, such as a Teflon plate 122, and the hinged grid sections in the upper run of the conveyor rest on the plates and are supported by the beams 120. The low friction material insures that the grid sections slide smoothly along the beams as the conveyor 16 is driven. The beams 120 are in turn supported by transverse beams 124 that extend under the longitudinal beams 120 and which are fastened to the opposite lateral walls 82, 84 of the enclosure 70.

The lower run of the conveyor 16 is supported within the enclosure 70 by means of sets of rollers 130,132 between each section of the conveyor as shown most clearly in FIG. 3, and rails 134, 136 on the inner side of the lateral side walls 82, 84. The rails 134, 136 are substantially co-extensive with the beams 120.

During movement of the layup by the conveyor, it is desirable to reduce the level of vacuum which secures the sheet material to the conveyor. Such a reduction decreases the load of the upper run of the conveyor on the support beams 122, 124 and also reduces the friction between the plates 122 and the grid sections 104 of the conveyor. Such a reduction can be accomplished by a bleed valve 135 in FIG. 2 or by reducing the speed of the vacuum pump 90. Generally a short segment of the layup L adjacent the loading end of the conveyor table 14 is not cut. There is little leakage through the uncut section and a more secure attachment is created between the layup and the conveyor at the loading end of the conveyor table 14 for pulling the next segment of the layup from the spreading table 12 onto the conveyor table.

FIG. 2 illustrates one design of the conveyor table 14 which permits a reduction in the vacuum and friction forces along most of the length of the support beams 120 without loss of attachment forces at the loading end of the table 14. A set of vertical baffle plates 137, 138 are installed in the tank-like enclosure 70 intermediate the bleed valve 135 and the connection of the vacuum pump 90 into the one portion of the enclosure 70 on the side of the baffle plates adjacent the loading end of the table.

During a cutting operation, the bleed valve 135 is closed and pressure or vacuum throughout the entire enclosure 70 and at the support surface of the conveyor 16 is the same. When the layup L of sheet material is to be moved by the conveyor, the bleed valve adjacent the discharging end of the table 14 is opened and a dynamic flow of air is established through the enclosure from one end to the other. The baffle plates 137, 138 extend in close fitting relationship with the upper and lower runs of the conveyor but provide a clearance which permits conveyor movement and allows limited leakage of air. The clearance behaves as an orifice to the dynamic flow and produces a pressure drop from one side of the baffles to the other. As a result, the friction and material holddown forces adjacent the discharge end of the conveyor are reduced, but the same forces at the loading end are preserved to secure the uncut segment of the layup to the conveyor for loading on the table 14.

One major advantage of the conveyor table 14 over the prior art table is the absence of a vacuum zoning system that applies the vacuum to limited portions of the support surface on which the layup of sheet material is held during cutting. With the present invention, the complex structure forming a plurality of vacuum chambers under the upper run of the conveyor, the valving mechanism for actuating each of the chambers and the mechanism actuating the valves in accordance with movement of the cutting blade 34 along the layup are all eliminated. The disclosed conveyor table is, accordingly, simpler in construction and much less expensive to manufacture and maintain. Additionally, the load on the vacuum pump with the enclosure 70 and without zoning the support surface of the table is less provided that appropriate means are employed to limit leakage through the cut material. This result is obtained for several reasons. In the prior art conveyor tables, the bristle blocks permitted air to flow not only vertically through the conveyor into the vacuum chambers, but also horizontally from the ends of the conveyor which were not sealed by end walls, such as the walls 74, 76 and aprons 78, 80. Although sacrificial barriers were commonly installed transversely in the bristles, after several cutting operations the barriers were destroyed and frequently were not replaced as required to maintain a cutting bed that inhibited horizontal flow from the ends of the conveyor.

Furthermore, the conveyor table 14 has no valves, ducting and chamber seals under the conveyor as additional sources of leakage into the vacuum system. In the zoned conveyor table of the prior art, the various leakage sources required a much larger vacuum generator. To maintain a vacuum of 5" of water at the support surface of the bristle blocks, it was necessary to draw a 10" vacuum at the pump connected through the ducts and valves to the bristles. With the conveyor table 14, a 6" vacuum at the pump produces substantially a 6" vacuum at the bristle support surface when an appropriate overlay covers the cut material. A substantial reduction in the power requirements of the vacuum system is achieved.

To seal the limp sheet material and the overlay 92 after they have been cut by the blade 34, the conveyor table 16 is provided with a sealing carriage 140 which spreads an air-impermeable overlay 142 on top of the layup.

FIGS. 1 and 2 illustrate the sealing carriage 140 and the associated components which permit the air-impermeable overlay 142 to be spread on top of cut portions of the layup as the cutting operation progresses. The carriage 140 straddles the conveyor table and is movable along the conveyor table on the same ways 40, 42 as the X-carriage 36. As shown more clearly in FIG. 4, the sealing carriage 140 has two wheels 146 and 148 that rest on the upper side of the way 44 and a lower gear wheel 150 that runs in the rack 49 engaged by the drive pinions of the X-carriage 36. The opposite side of the carriage 140 is similarly supported on the way 42.

The air-impermeable overlay 142 is a strip of material such as a 3 mil Mylar that is secured at one end to a stationary bridge 144 mounted on the unloading end of the table and straddling the layup on the table. The opposite end of the strip is wound onto a self-retracting roller 160 mounted on the carriage 140 as shown in detail in FIG. 5. The roller includes an outer cylinder 162 that is rotatably mounted at one axial end on a stationary collar 164 and at the opposite end on a non-rotatable axle 168. A coil return spring 170 is mounted coaxially about the axle 168 and is secured at one end to the stationary collar 164, and at the opposite end to the cylinder 162. In this manner, the return spring produces a retracting torque on the roller 160 and causes the overlay 142 to be wound onto the roller from an unwound condition in much the same manner as a roller shade. To ensure that the overlay 142 is pressed against the layup in opposition to retracting forces produced by the spring 170, a weighted bar 190 is pivotally connected to the sealing carriage and extends transversely over the overlay 142 as shown in FIG. 4.

With the one end of the overlay 142 secured to the bridge 144, the overlay material is spread on top of the cut portions of the layup by connecting the sealing carriage 140 to the X-carriage 36 and moving the sealing carriage along the conveyor table over the layup. To this end, a pair of connecting links 180 are pivotally connected to each lateral side of the X-carriage 36 as shown in FIG. 4, and the extended ends of the links include latches 184 that engage connecting pins 186 at each side of the sealing carriage 140. The links are disengaged from the sealing carriage 140 by means of electric or pneumatic actuators 182 mounted on the X-carriage to life the links 180 away from the pins 186 on the carriage 140. When the links are disengaged and the actuators 182 are not energized, the links rest on the stops 188 at substantially the same height as the connecting pins 186.

Accordingly, the cutting blade 34 initiates a cutting operation adjacent the discharging end of the conveyor table 14 and works progressively through the layup toward the loading end while cutting the pattern pieces P. During cutting the sealing carriage 140 is coupled to the X-carriage 36 by the links 180 so that the cut portion of the layup located between the carriage 36 and the discharging end of the table is covered by the overlay 142. The overlay material seals the cuts or kerfs generated by the cutting blade in the sheet material and the sacrificial overlay 92. By sealing the cuts as cutting takes place, very little air leaks through the layup and the air-permeable conveyor into the enclosure 70, and therefore the workload on the vacuum pump 90 is greatly reduced.

In contrast to the teachings of U.S. Pat. No. 3,742,802, the overlay 142 is mounted on the separate sealing carriage 140 o that the overlay can be removed from the layup of sheet material prior to any movement of the layup by means of the conveyor belt 16. Since the conveyor is slaved to the X-carriage 36 for movement of the layup, and since the overlay 142 must be removed before movement, the sealing carriage must be uncoupled from the X-carriage and be returned to a parking position shown in FIG. 4 in phantom before the layup L can be moved off the discharging end of the table. Otherwise, the overlay 142 would be held against the upper ply of the layup and become entangled with the bridge 144 as the cut sheet material passed underneath.

Accordingly, when the cutting machine 10 has completed a cutting operation in the vicinity of the loading end of the conveyor table, the movement of the X-carriage 36 stops and the actuators 182 uncouple the links 180 from the sealing carriage 140. At that point, the retracting torque in the roller 160 lifts the overlay upwardly off of the layup and winds the overlay 142 back onto the roller. Simultaneously the overlay pulls the sealing carriage 140 along the ways 42, 44 back to the discharging end of the table. At the discharging end, the rolled overlay is pulled into a parking position on a ramp 192 projecting from the bridge 144. In this position, the overlay is free of the layup and movement of the layup under the bridge 144 can take place without sliding the overlay on the layup and possibly disturbing the cut pattern pieces.

When X-carriage 36 returns to the discharging end of the conveyor table 14 with the slaved conveyor belt and the layup "in tow", the latches 184 automatically reengage the connecting pins 186 in preparation for drawing the sealing carriage 140 away from the parking ramp 192 and spreading the overlay 142 on top of the sheet material during cutting of the next segment of the layup.

Although the overlay is not spread on top of the layup L during movement of the layup by the conveyor 16, the load on the vacuum generating means is not a significant problem because the vacuum level is lowered and the indexing operation is brief. The lowered level is used to relieve the load and friction forces between the conveyor belt 16 and the beams 120 supporting the conveyor. Also, a high vacuum level for compressing the sheet material is not needed because no cutting is taking place. The vacuum is only utilized to capture the layup on the conveyor as the conveyor pulls a new segment of the layup onto the table 14.

Accordingly, a cutting machine has been disclosed in which a vacuum holddown system is assisted by means of an air-impermeable overlay spread over the cut sheet material by a sealing carriage. The carriage is coupled to the tool carriage supporting the cutting blade for progressive movement over the layup during a cutting operation. When the cutting operation on a particular segment of the material is complete, the sealing carriage is uncoupled from the tool carriage, and a self-retracting roller rewinds the spread overlay back onto the sealing carriage and simultaneously pulls the carriage toward a parking position adjacent one end of the table.

While the present invention has been described in a preferred embodiment, it should be understood that numerous modifications and substitutions can be had without departing from the spirit of the invention. For example, the self-retracting roller on the sealing cariage may be energized either by a metallic coil spring as shown, an elastomeric spring or a small torque motor. The latches which couple and uncouple the sealing carriage from the tool carriage can take various forms and can be mounted on either the sealing carriage or the tool carriage to establish a coupling between the carriages. Of course, numerous other types of couplings may be employed including pneumatic, electric and magnetic couplings. Accordingly, the present invention has been described in a preferred embodiment by way of illustration rather than limitation.

I claim:

1. An automatically controlled cutting machine for cutting layups of limp sheet material comprising:

a cutting table in the form of a conveyor table having a conveyor belt defining a support surface on which a multi-ply layup of limp sheet material is spread for cutting and for movement along the table;

a tool carriage movable back and forth over the cutting table and having a cutting tool movable with the carriage to perform cutting operations on the material;

vacuum generating means connectable with the layup of sheet material on the support surface for generating a vacuum within the layup and compressing the sheet material on the support surface; and a sealing carriage also movable back and forth over the cutting table and carrying a retractable roll of an air-impermeable overlay material, the free end of the roll being connected with one end of the cutting table, the sealing carriage also being releasably coupled with the tool carriage for movement with the tool during cutting operations and spreading the overlay material on the portion of the sheet material between said one end of the table and the sealing carriage to seal cuts in the material and prevent loss of vacuum in the layup, the sealing carriage being releasable from the tool carriage to retrieve the overlay material from the layup before the layup is moved along the table by the conveyor belt.

2. An automatically controlled cutting machine as described in claim 1 wherein the retractable roll of overlay material is a self-retracting roll.

3. An automatically controlled cutting machine as described in claim 1 wherein the sealing carriage may be uncoupled from the tool carriage and be parked adjacent said one end of the cutting table with the overlay material retrieved on the roll to allow the conveyor belt to move the layup without the overlay material thereon.

4. An automatically controlled cutting machine as described in claim 3 further including means for selectively coupling the conveyor belt with the tool carriage for moving the conveyor belt and the sheet material thereon in known registration with the tool carriage between cutting operations on different segments of the layup.

5. An automatically controlled cutting machine as described in claim 4 wherein:

the conveyor includes a conveyor drive motor connected in driving relationship with the conveyor belt; and the means for selectively coupling comprises sensing means for detecting movement of the tool carriage relative to the support surface of the conveyor and producing a signal indicative of the relative movement, and motor control means selectively responsive to the sensing means signal and connected to the conveyor drive motor for energizing the motor and causing the conveyor to follow the tool carriage movements.

6. An automatically controlled cutting machine as described in claim 1 wherein the retractable roll of air-impermeable overlay material includes a rotatable roller on which the overlay material is wound and a resilient retraction mechanism allowing the material to be wound onto and off of the roller.

7. An automatically controlled cutting machine as defined in claim 1 wherein the support surface of the cutting table is air-permeable; and the vacuum generating means is connected with the layup of sheet material through the air-permeable support surface for generating the vacuum within the layup.

8. A method of cutting limp sheet material under vacuum with a cutting machine having a work table defining a work surface for holding the material during cutting comprising:

spreading the limp sheet material on the work surface of the work table;

applying a vacuum to the limp sheet material to hold the material under vacuum on the work surface;

cutting the limp sheet material on the work surface of the table under vacuum with a cutting tool mounted on a tool carriage and movable along the work table to reach different cutting areas of the table;

mounting a roll of air-impermeable overlay material on a sealing carriage different from the tool carriage, the sealing carriage also being movable along the work table;

securing an unrolled portion of the overlay material to the work table adjacent said one end whereby joint movement of the tool and sealing carriages generally away from said one end of the table during cutting unrolls the overlay material and spreads the material over the work surface and the limp sheet material thereon for sealing;

coupling the sealing carriage to the tool carriage for joint movement along the work table generally from one end of the work table toward the other during the step of cutting;

terminating the step of cutting at a cutting area of the work table remote from said one end;

uncoupling the sealing carriage from the tool carriage after the step of cutting is terminated at the remote area; and returning the uncoupled sealing carriage from the remote area toward said one end of the work table without the cutting tool and tool carriage and simultaneously retracting the air-impermeable overlay material onto the roll on the sealing carriage to expose the cut sheet material.

9. A method of cutting limp sheet material as defined in claim 8 wherein an additional step includes mounting the roll of air-impermeable overlay material on a selfretracting roll of the sealing carriage, and the step of returning comprises allowing the self-retracting roll of draw the uncoupled sealing carriage toward said one end of the work table to expose the cut sheet material.

10. A method of cutting limp sheet material as defined in claim 8 wherein:

the work table comprises a conveyor table on which segments of the sheet material are moved for cutting in first and second sequential cutting operations respectively; and additional steps include:

starting both the first and the second of the sequential cutting operations adjacent said one end of the table and moving progressively away from said one end toward a remote area of the table during cutting;

the steps of uncoupling and returning being performed between the first and second cutting operations to uncover the cut sheet material; and moving a segment of uncut sheet material on the support surface of the conveyor table for the second cutting operation with the sheet material uncovered during movement of the material.

11. A method of cutting limp sheet material as defined in claim 10 including the step of reducing the level of vacuum applied to the sheet material during the step of moving a segment of sheet material on the conveyor table.

12. A method of cutting limp sheet material as defined in claim 10 or 11 further including the step of operatively coupling the conveyor table and the tool carriage together for joint movement during the step of moving a segment of uncut sheet material on the conveyor table to maintain a positional correlation between the tool carriage and the sheet material between the first and second cutting operations.

* * * * *